United States Patent [19]

Kato et al.

[11] Patent Number: 5,070,688

[45] Date of Patent: Dec. 10, 1991

[54] CLEANING DEVICE FOR CLEANING A NOZZLE IN A SPINNING APPARATUS

[75] Inventors: Hisaaki Kato, Shiga; Takumi Yamamoto, Nagaokakyo; Hiroshi Yamaguchi, Kyoto; Hideshi Mori, Joyo, all of Japan

[73] Assignee: Murata Kikai Kabushiki Kaisha, Kyoto, Japan

[21] Appl. No.: 383,364

[22] Filed: Jul. 20, 1989

[30] Foreign Application Priority Data

| | | | |
|---|---|---|---|
| Jul. 25, 1988 | [JP] | Japan | 63-185057 |
| Nov. 14, 1988 | [JP] | Japan | 63-286985 |
| Nov. 15, 1988 | [JP] | Japan | 63-289887 |
| Nov. 28, 1988 | [JP] | Japan | 63-300349 |
| Dec. 29, 1988 | [JP] | Japan | 63-335277 |

[51] Int. Cl.[5] ..... D01H 11/00

[52] U.S. Cl. ..... 57/304; 57/305; 57/328

[58] Field of Search ..... 57/304, 305, 328, 261, 57/300, 306; 19/262, 263, 264

[56] References Cited

U.S. PATENT DOCUMENTS

| | | | |
|---|---|---|---|
| 4,519,199 | 5/1985 | Barauke | 57/304 X |
| 4,550,560 | 11/1985 | Tanaka et al. | 57/261 |
| 4,662,167 | 5/1987 | Stahlecker | 57/304 X |
| 4,819,419 | 4/1989 | Stahlecker et al. | 57/328 X |
| 4,825,634 | 5/1989 | Halder et al. | 57/304 X |
| 4,858,421 | 8/1989 | Stahlecker | 57/304 X |
| 4,876,848 | 10/1989 | Vitak et al. | 57/304 X |

*Primary Examiner*—Stuart S. Levy
*Assistant Examiner*—Steven M. duBois
*Attorney, Agent, or Firm*—Spensley Horn Jubas & Lubitz

[57] ABSTRACT

A cleaning device for cleaning a nozzle in a spinning apparatus in which the nozzle unit is supported movably and a suction pipe for sucking yarn waste is oscillatingly supported so that a suction opening of the suction pipe can be moved to a gap between the draft part and the nozzle unit moved away from the draft part.

11 Claims, 8 Drawing Sheets

CLEANING DEVICE FOR CLEANING A NOZZLE IN A SPINNING APPARATUS

FIELD OF THE INVENTION

The present invention relates to a cleaning device for clearing a spinning frame which provides with a nozzle unit for twisting a fiber bundle.

RELATED ART STATEMENT

There has been known an apparatus for producing spinning yarns in which a fiber bundle prepared by drafting a sliver by paired draft rollers is twisted while passing it through a nozzle unit having a nozzle which jets pressurized air.

In such an apparatus as described above, when the fiber bundle is introduced into the nozzle unit, short fibers around the fiber bundle are slipped out of and separated from raw yarns or the fore ends of the short fibers entangled on the fiber bundle are cut and these are accumulated around the opening of the nozzle unit, sometimes resulting in a clogging of nozzle.

When such a condition as described above occurs, yarn-breakage or the like naturally results. At the present, when a yarn-breakage signal is issued, an operator manually removes fibers adhered to the end of the nozzle.

The yarn-cut signal is generated by a slab catcher. The slab catcher includes two cases. In one case, when a coarseness of yarn exceeds a limit of a prescribed value, the slab catcher detects it, cut the yarn by itself and provides a yarn cut signal. In the other case, a yarn breakage occurs for some other reason, and the slab catcher provides a yarn-cut signal. In the latter case, mostly, short fibers or yarn waste are adhered to an inlet of the nozzle unit to thereby cause yarn breakage.

OBJECT AND SUMMARY OF THE INVENTION

It is an object of the present invention not to produce accumulation of dust containing the short fibers or yarn waste in the vicinity of an inlet of a fiber bundle of a nozzle unit.

According to an embodiment of the present invention, in a spinning apparatus in which a nozzle unit for twisting a fiber bundle is provided subsequent to a draft part for the fiber bundle, the nozzle unit is supported movably so that a suction opening of the nozzle unit can be moved to and away in relation to the draft part, and a suction pipe for sucking yarn waste is oscillatingly supported so that a suction opening thereof can be moved to a gap between the draft part and the nozzle unit moved away from the draft part.

A yarn suction opening provided on the nozzle unit close to the side of a front roller of the draft part is moved away from the draft part by oscillation of an oscillating member supporting the nozzle unit to form a gap portion on the side of the front roller. On the other hand, the suction pipe is oscillated till the end thereof reaches the gap portion to generate a suction air stream in the suction pipe to such and remove yarn waste, short fibers or the like in the vicinity of the yarn suction opening of the nozzle unit and the front roller.

BRIEF DESCRIPTION OF THE DRAWINGS

FIGS. 1 to 4 show a first embodiment of the present invention, in which FIG. 1 is a side view of an apparatus, FIGS. 2 and 3 are sectional views of a nozzle and an end portion of a suction pipe, respectively, and FIG. 4 is a plan view of a suction pipe oscillating mechanism;

FIGS. 6 to 10 show third and fourth embodiments of the present invention, in which FIG. 6 is a side view, FIGS. 7 and 9 are a sectional view of an end portions of a suction pipe of the third embodiment and a plan view of FIG. 7, respectively, and FIGS. 8 and 10 are a sectional view of an end portion of a suction pipe of the fourth embodiment and a plan view of FIG. 8, respectively;

FIGS. 11 and 12 show a fifth embodiment of the present invention, in which FIG. 11 is a sectional view of an end portion of a suction pipe and FIG. 12 is a section taken along a line A—A in FIG. 11;

FIGS. 13 to 16 show a sixth embodiment of the present invention, in which FIG. 13 is a side view, FIG. 14 is a front view of a connector, FIG. 15 is a right side view of the connector and FIG. 16 is a right side view of the connector.

DETAILED DESCRIPTION OF PREFERRED EMBODIMENTS

Figure 1:
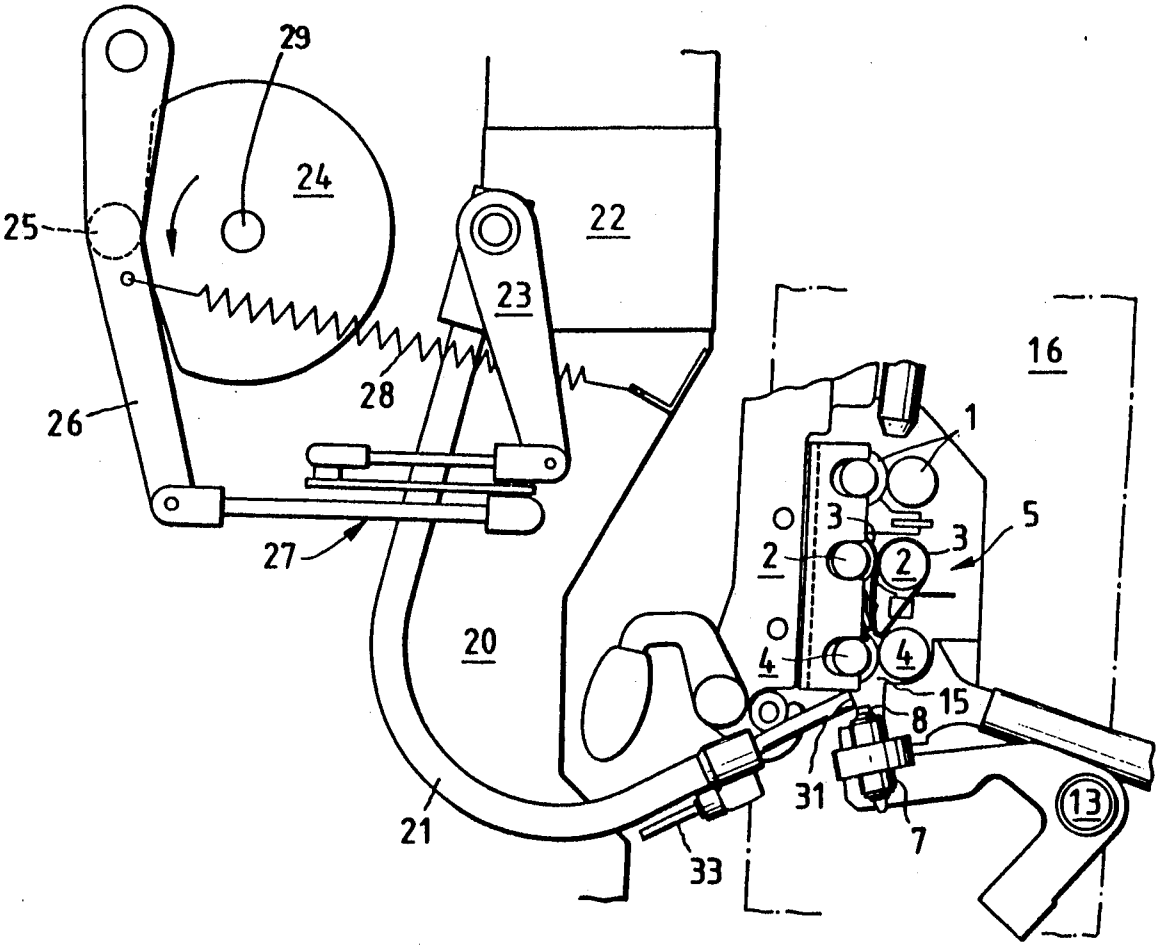
Figure 2:
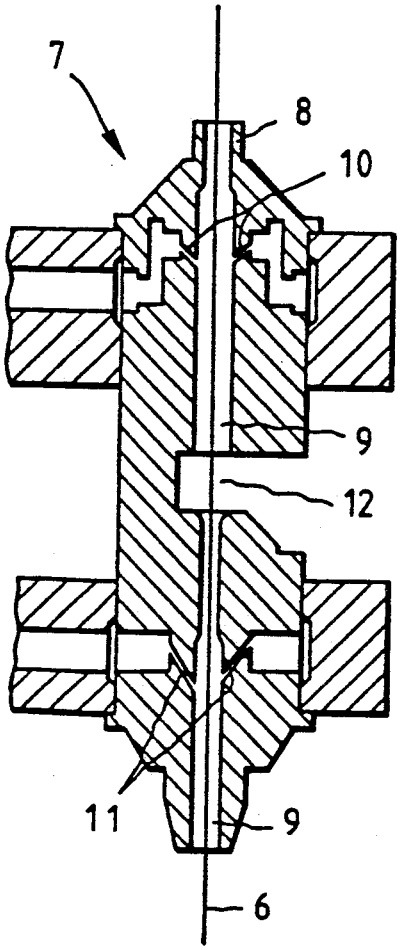
Figure 3:
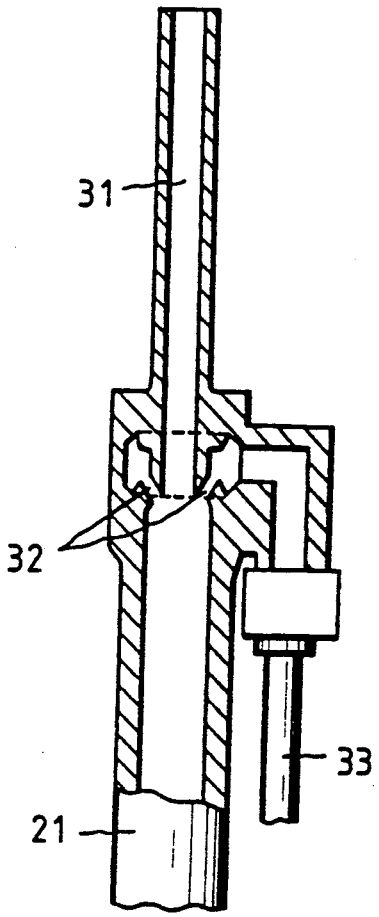
Figure 4:
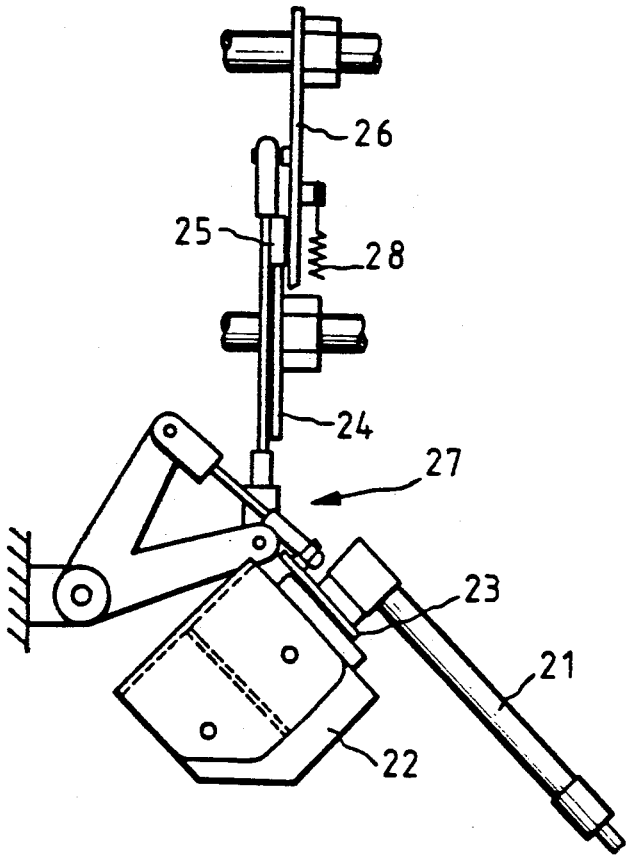

Embodiments of the apparatus according to the present invention will be described with reference to the drawings.

A first embodiment of the spinning apparatus of the present invention has a back roller 1, a draft part 5 comprising an apron 3 extended over a middle roller 2 and a front roller 4, and a nozzle unit 7 for receiving and twisting a fiber bundle 6 from the front roller 4 of the draft part 5 provided in said order.

The nozzle unit 7 is in the form of a cylinder as a whole and formed in a center of a conical head thereof with a nipple 8, and in a central portion thereof is extended through a yarn passing hole 9 for receiving a fiber bundle fed from the draft part 5. First and second nozzles 10 and 11 toward the yarn passing hole 9 are respectively provided on the front and rear stages of the yarn passing hole 9. The first nozzle 10 is so formed as to jet pressurized air in a inclined direction to a yarn moving within the yarn passing hole 9 to feed the yarn in a moving direction, and has a function to receive the fiber bundle 6 into the nozzle unit 7. The second nozzle 11 is opened to the yarn hole 9 obliquely to the tangential direction thereof to jet pressurized air for twisting yarn within the yarn passing hole 9. An open portion 12 is provided between the first and second nozzles, and a jet flow jetted from the first nozzle 10 is discharged outside the nozzle unit through the open portion 12.

The nozzle unit 7 is supported on an oscillating arm 14 about an axis 13. In FIG. 1, when the nozzle unit 7 is oscillated clockwise, the nipple 8 of the nozzle unit 7 moved to a portion near the nipped point of the paired front rollers 4 of the draft part 5, whereas when oscillated counterclockwise, a gap portion 15 is formed in the vicinity of the nipped point.

A plurality of units including the draft part 5 and the nozzle unit 7 are placed on the machine bed 16 in parallel, and a truck 20 for carrying out doffing or the like travels in front of the units. The truck 20 stops at the front of the unit disposed on the machine bed 16 to perform operation as requested by the unit.

The cleaning device of the present invention cleans an intermediate position between the front roller 4 of the draft part 5 and the nozzle unit 7, and therefore a suction pipe 21 is moved from the truck 20 side toward the gap portion 15 formed in the intermediate portion to suck the fibers accumulated on the gap portion 15.

The suction pipe 21 is oscillatingly supported on a dust box 22 of the truck 20. An oscillating arm 23 integral with the suction pipe 21 is connected to a cam 24 by an oscillating arm 26 and a connecting rod 27 through a cam follower 25. The oscillating arm 26 is urged in a direction of the cam 24 by means of a spring 28.

The oscillation of the suction pipe 21 may be made in a direction perpendicular to the machine bed 16 from the front of the machine bed 16, but it is preferable to depict an oscillating locus close to the gap portion 15 from an oblique direction, for example, in view of arrangement of the front roller 4 and the nozzle unit 7.

A suction opening 31 at the end of the suction pipe 21 is provided at the base with a plurality of jet holes 32 which surrounds the suction opening 31 to jet pressurized air inwardly of the suction pipe 21. The jet holes 32 are in continuous to a pressure pipe 33.

Assume now that the slub catcher is actuated and the unit stops. Prior to yarn splicing, the cleaning device is actuated to clean dust containing short fibers accumulated between the nozzle unit 7 and the draft part 5. To this end, the nipple 8 of the nozzle unit 7 provided in the proximity of the front roller 4 has to be moved away from the front roller 4. The oscillating arm 14 supporting the nozzle unit 7 is turned counterclockwise in FIG. 1 about the shaft 12 to assume the state shown in FIG. 1. Thereby, the gap portion 15 can be formed between the front roller 4 and the nipple 8 at the end of the nozzle unit. By rotation of the cam 24 supported on the cam shaft 29, the suction pipe 21 is turned through the cam follower 25, oscillating arm 26, connecting rod 27 and oscillating arm 23, and a suction opening 31 at the end thereof is positioned in the vicinity of the nipple 8 of the nozzle unit 7 and the gap portion 15 to start suction. The aforesaid suction is conducted by jetting pressurized air from the jet hole 32 opened inwardly of the suction pipe to thereby generate negative pressure at the end of the suction pipe 21.

The jetting of pressurized air from the jet hole 32 is controlled by opening and closing a valve not shown provided on the pressure air pipe 33 according to a turning angle of the suction pipe.

The accumulated fibers or the like sucked by the suction opening 31 of the suction pipe 21 are collected in the dust box 22 and then removed when the truck reaches the end of the machine bed.

In the first embodiment mentioned above, the suction opening 31 is formed to be straight. The suction opening 31 may be constructed as shown in FIGS. 5*a*, 5*b* and 5*c* when fiber wastes clogged in the nipple 8 are intended to be removed.

Figure 5A:
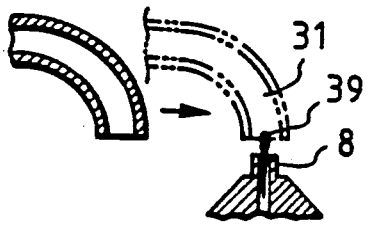
FIGS. 5*a*, 5*b* and 5*c* are sectional views of end portions of suction pipes of a second embodiment of the present invention.
Figure 5B:
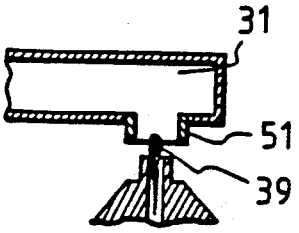
Figure 5C:
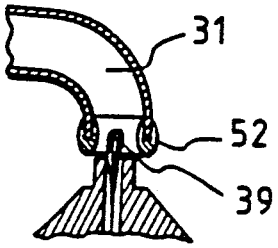

FIGS. 5*a*, 5*b* and 5*c* show three kinds of modes of the suction opening 31 at the end of the suction pipe 21, showing the state wherein the suction pipe 21 is moved to the gap portion 15 when the nozzle unit 7 has been moved away. FIG. 5*a* shows the mode wherein the suction opening 31 is directed toward the nipple 8 of the nozzle unit 7, and the end of the suction pipe 21 is curved. FIG. 5*b* shows the mode wherein the nipple 8 is directed toward the end of the suction pipe 21, and a further pipe 51 is adhered thereto, the pipe 51 being formed of metal but preferably being formed of a resilient material such as soft polyurethane so that its function may perform even if it impinges upon the nipple 8. FIG. 5*c* shows the mode wherein an annular member 52 made of sponge is mounted on the end of the suction opening 31 to reduce a clearance of the nozzle unit 7 with respect to the nipple 8. The numeral 39 denotes fiber wastes clogged in the nipple 8.

An embodiment in which a fiber waste gripping device is disposed in the vicinity of the suction opening 31 is described hereinafter.

Figure 6:
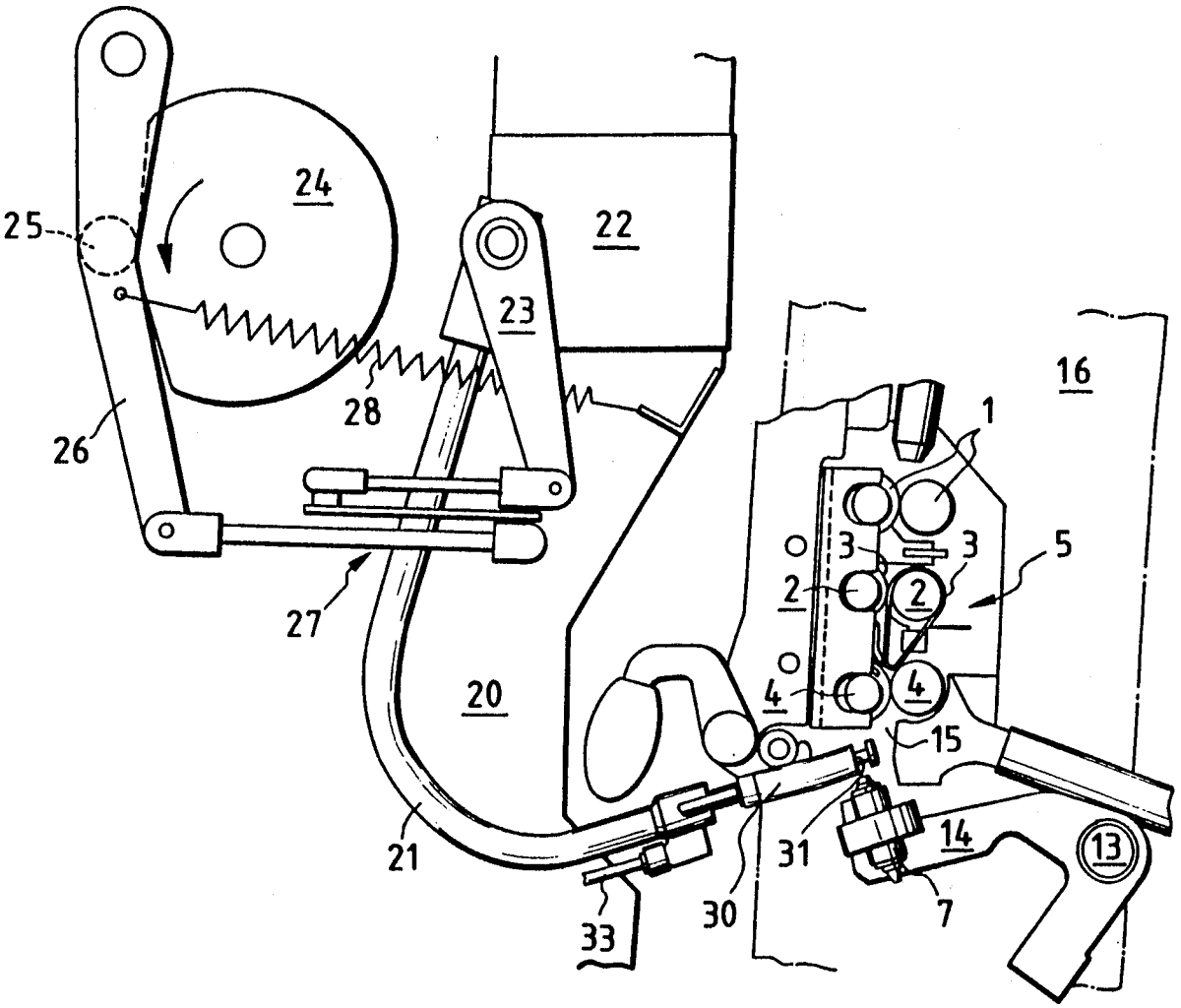
Figure 7:
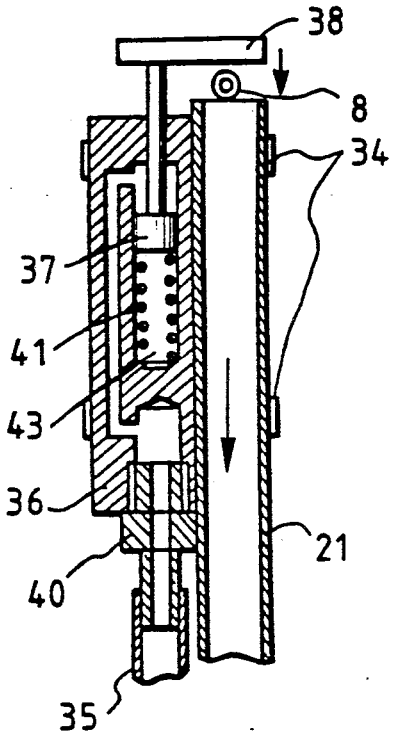
Figure 8:
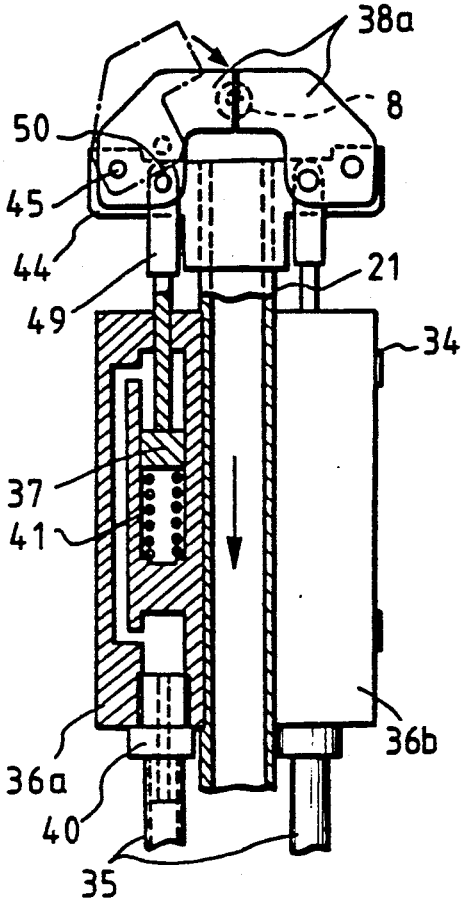
Figure 9:
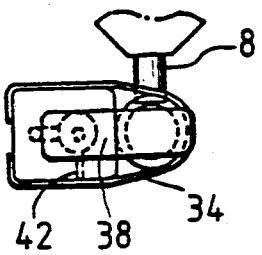
Figure 10:
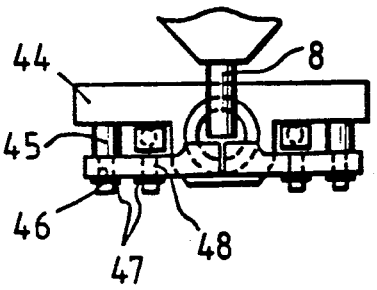

As shown in FIGS. 6 to 8, the apparatus for automatically removing nozzle-clogging of this embodiment acts to remove the fiber wastes clogged in the suction opening 31 of the nozzle unit 7 and to clean the circumference of the suction opening 31 before a yarn joining operation in the unit where a yarn joining operation is requested upon a yarn breakage. The suction pipe 21 and a fiber waste gripping body 30 are advanced from the truck side toward the gap portion 15 to grip an end portion 39 of the fiber wastes clogged in the suction opening 31 of the nozzle unit 7 (as shown in FIG. 5) and to pull out of the clogged fiber wastes. At the same time, the suction pipe 21 sucks to remove fiber wastes and short fibers accumulated around the suction opening 31. FIGS. 9 and 10 are plane views of FIGS. 7 and 8, respectively.

A fiber waste gripping body 30 is mounted on the end of the suction pipe 21 so that the former may be oscillated integral with the suction pipe 21. FIG. 7 shows one example of the fiber waste gripping body and FIG. 8 shows a further example thereof, in which the fiber waste gripping body 30 is mounted on the suction pipe 21 by means of a flat spring 34. When an air valve not shown is opened to supply air to an air cylinder 36 through an air pipe 35, a piston 37 is moved downward and a gripping plate 38 is moved in a direction as indicated by arrow (the gripping plate 38 is turned in the example shown in FIG. 8) whereby an air cylinder 36 designed to hold fiber waste 39 clogged in the yarn hole 9 (in the first example, between the gripping plate 38 and the end of the suction pipe; in the second example, by two left and right gripping plates 38*a*, 38*b*) and an air pipe 35 are connected by a joint 40. Reference numeral 41 denotes a spring for raising the piston 37 the air valve is closed, and numeral 42 denotes an air hole for causing air within the air chamber 43 to escape when the piston 37 is moved downward.

FIG. 8 shows the example which uses two air cylinders 36*a* and 36*b*. A bracket 44 is mounted on the end of the suction pipe 21, and a stepped pin 45 is pressed into the bracket. The gripping plate 38 is turnably mounted by fitting a small diameter portion at the tip of the stepped pin 45 into one loose hole 46 bored in the gripping plate 38*a*. Numeral 47 denotes a snap ring for preventing the gripping plate 38*a* from being slipped out. A rod 49 having a pin 48 at the end thereof is fitted into a head of the piston 37, and the other loose hole 50 of the gripping plate 38*a* is fitted into the pin 48.

Thereby, vertical movement of the piston 37 is converted into turning of the gripping plate 38*a*. Operation of the suction pipe 21 after arrival of the suction opening 31 at the front of the nipple 8 will be illustrated. The suction from the suction opening 31 is carried out by jetting pressurized air from a jet hole 32 positioned at the end of the suction opening 31 at the end of the suction pipe and opened inwardly of the suction pipe 21 to thereby generate negative pressure at the end of the suction pipe. On the other hand, gripping operation is carried out opening the air valve to conduct air into the air cylinder 36, or 36*a*, or 36*b* through the air pipe 35 to pull down the piston 37.

In succession to the gripping operation, the cam 24 is further rotated, the suction pipe 21 and the fiber waste gripping body 30 while maintaining the gripping state are turned in a direction of moving away from the suction opening of the nozzle unit 7. By this movement, the fiber waste clogged in the yarn hole 9 is drawn out of the yarn hole 9 while being held by the gripping plate 38, or 38*a*, or 38*b*. Next, by closing the air valve, the piston 37 within the air cylinder 36, or 36*a*, or 36*b* is pushed up by repulsion of the spring 41 to open the gripping plate 38, or 38*a*, or 38*b* to release the fiber waste being held. At this time, the suction pipe 21 is in the suction state, and the released fiber waste is sucked from the suction opening 31 and collected in the dust box 22. The fiber waste is removed when the truck travels and reaches the end of the machine bed.

Figure 11:
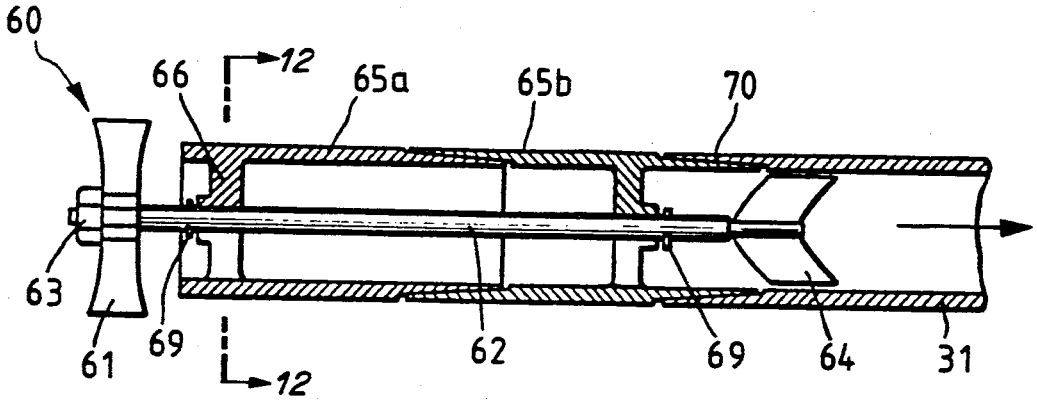
Figure 12:
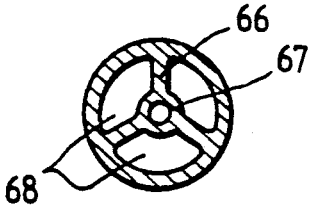

Referring to FIGS. 11 and 12, a fifth embodiment in which a rotary cleaning body for fiber wastes is provided in the vicinity of the suction opening 31 will be illustrated.

A rotary cleaning body 60 is mounted on the end of the suction opening 31 so that the former may be oscillated integral with the suction pipe 21. FIG. 11 shows one embodiment of the rotary cleaning body. This embodiment utilizes an air flow within the suction pipe 21 to rotate the rotary cleaning body. A brush 61 is detachably secured to one end of a shaft 62 by means of a nut 63. A blade 64 is pressed in and secured to the other end of the shaft 62. Sleeves 65*a* and 65*b* are in the form of a tube formed of synthetic resin which is small in frictional coefficient with respect to the shaft 62, for example, polyamide group resin. The sleeve is internally provided with a bearing portion 67 supported by a rib 66, and a large hole 68 is formed between the ribs so as not to impede a flow of air. The sleeve shown is constituted by two parts 65*a* and 65*b* because molding may be facilitated but an integral formation may also be employed. In the present embodiment, the sleeve is divided into two parts, and therefore, one sides of ends thereof are in the form of male and female tapers, which are pressed to form an integral configuration. The inside diameter of the bearing portion 67 of the sleeve is made slightly larger than the outside diameter of the shaft 62 so that the shaft 62 having the blade 64 mounted on one end thereof is rotatably inserted into the bearing portion 67 and the brush 61 is mounted on the other end to constitute the rotary cleaning body 60. A snap ring 69 is provided to prevent axial movement of the shaft 62. One end of the rotary cleaning body 60 has a taper 70 to be fitted into the suction opening 31 and is mounted by pressing it into a female taper worked at the end of the suction opening 31 of the suction pipe 21. The blade 64 is a normal impeller in which a plurality of thin sheets are obliquely arranged on the circumference, the impeller being rotated by receiving a flow of air. FIG. 12 is a sectional view taken along a line A—A in FIG. 11.

The blade 64 of the rotary cleaning body 60 is rotated by the air flow generated within the suction opening 31 to thereby rotate the brush 61 positioned directly before the suction opening of the nozzle unit 7. The brush 61 may be in the form that nylon bristles used for a tooth brush or the like are planted on a cylindrical plate, that fine wires used for a wire brush or the like in place of the nylon bristles are used, or that of a cylindrical plate formed of soft polyurethane or rubber having pyramid-like concavo-convexes added to the outer peripheral surface thereof to obtain good results. The outer peripheral surface of the brush 61 rotates while contacting a head of fiber waste clogged in the yarn hole 9 of the nozzle unit 7, and therefore, the fiber waste is swept away by the frictional force of the outer peripheral surface of the brush 61 and then sucked by the sucking air flow of the suction opening 31, collected into the dust box 22 and finally removed when the truck travels to reach the end of the machine bed.

An apparatus of detecting nozzle-clogging comprising a hollow pipe 126 disposed on the truck 20 into close communication with the suction pipe 21 and whereby a flow rate of air in the nozzle is measured after the nozzle is cleaned by the cleaning devices mentioned above, will be disclosed hereinafter.

Figure 13:
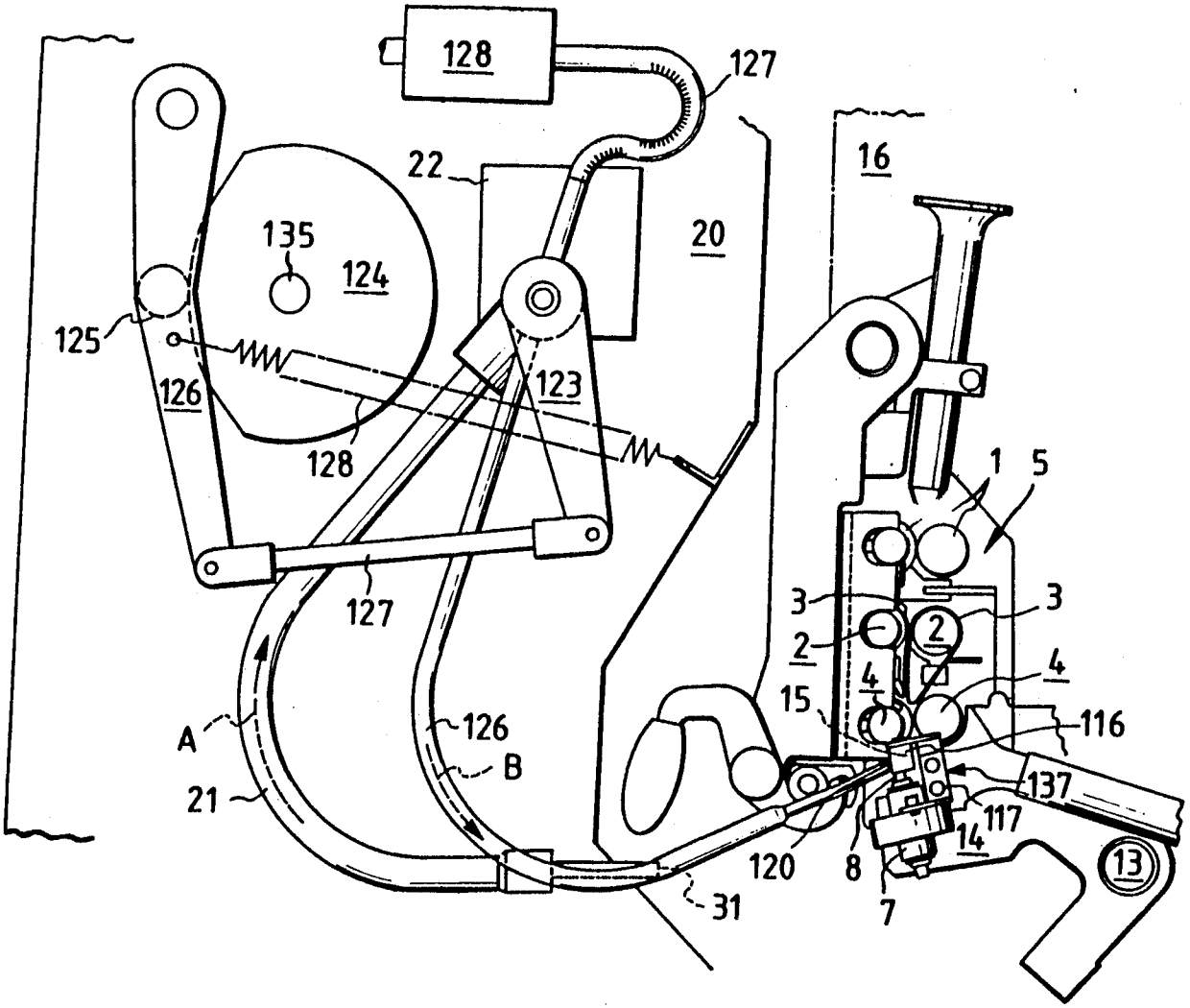
Figure 14:
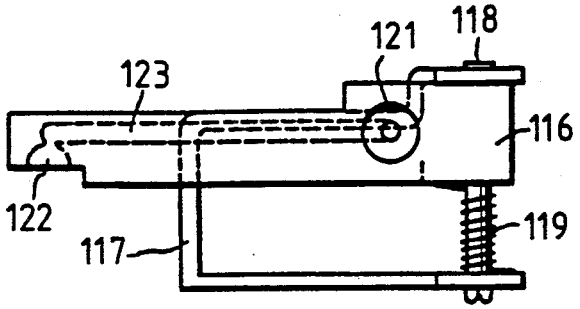
Figure 15:
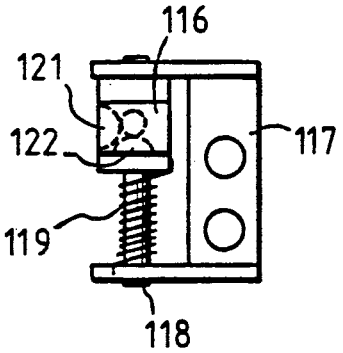

That is, as shown in FIGS. 13 and others, a contact opening 120 of a hollow pipe 126 connected to a flow meter 128 described later is moved toward the gap portion 15, and as a device for connecting the contact opening 120 with a nipple 8 of the nozzle unit 7, a connector 137 is provided on the side between the front roller 4 and the nozzle unit 7.

Figure 16:
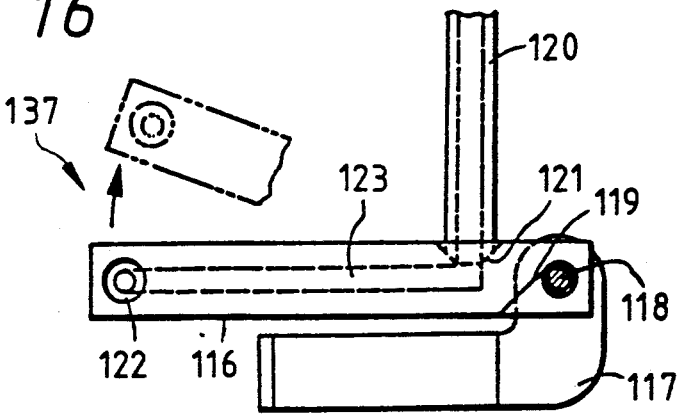

The connector 137 has a communication pipe 116 oscillatingly supported on the support member 117, the communication pipe 116 being normally withdrawn frontwardly of the gap portion 15 but can be moved into the gap portion 15 without contact with the nozzle unit 7 when the nozzle unit 7 is turned downwardly to form the gap portion 15. The support member 117 is fixed by a suitable member separately from the oscillating arm 14, and the end of the communication pipe 116 is oscillatingly supported by the shaft 118. A spring 119 is slipped over the shaft 118, and the end of the communication pipe 116 is always urged in a direction of moving away from the support member 117, that is, in a direction of moving away from the gap portion 15. A recessed portion 121 in contact with the contact opening 120 of the hollow pipe 126 connected to a flow meter 128 described later is provided frontwardly of the base of the communication pipe 116, and a recessed portion 122 in contact with the nipple 8 when the nozzle unit 7 moved up is provided in the lower surface at the end of the communication pipe 116, the recessed portions 121 and 122 being connected by a pipe 123. The communication pipe 116 is positioned at its end outside the gap portion 15 during spinning, as shown in FIG. 16 by a chain line, but during the operation of detecting the nozzle-clogging after the yarn hole 9 including the gap portion 15 and the nipple 8 of the nozzle unit 7, the aforesaid end is positioned within the gap portion 15 which will be described later.

The draft parts 5 and nozzle units 7 arranged in plural units are provided on the machine bed 16, and truck 20 travels in front thereof. When the unit on the machine bed 16 side is cleaned, the truck 20 stops in front of the unit and the suction pipe 21 is moved into the gap 15 to effect cleaning. Then, operation of detecting the presence or absence of the nozzle-clogging of the nozzle unit 7. That is, the hollow pipe 126 is oscillatingly provided on the truck 20, and the base of the hollow pipe 126 has the flow meter 128 connected thereto via a flexible tube 127.

A oscillating arm 123 is urged against a cam 124 by a spring 128.

In the cam 24 for driving the turning of the suction pipe 21 and the cam 124 for driving the turning of the hollow pipe 126, the former cam actuates the pipe 21 earlier than the latter, and the latter cam 124 actuates the pipe 126 after the turning of the pipe 21 is restored to its original position.

Assume now that the cleaning device is actuated so that the truck 20 stops to remove dust containing short fibers or the like accumulated between the nozzle unit 7 and the front roller 4 of the draft part 5. To this end, first, the nipple 8 of the nozzle unit 7 provided in the proximity of the front roller 4 has to be moved away from the front roller 4. The oscillating arm 14 supporting the nozzle unit 7 is turned counterclockwise as shown in FIG. 13 about the shaft 13 by suitable means. Thereby, the gap portion 15 can be formed between the front roller 4 and the nipple 8 at the end of the nozzle unit. The suction pipe 21 for collecting dust is turned and the suction opening at the end thereof is positioned in the vicinity of the nipple 8 of the nozzle unit 7 and the gap portion 15 to start sucking to remove the accumulated fibers, dust and the like. After a lapse of predetermined time, the suction pipe 21 for collecting dust is moved backward, and instead, the hollow pipe 126 for detecting nozzle-clogging is moved toward the gap portion 15.

The backward movement of the suction pipe 21 for collecting dust and the advance of the hollow pipe 126 for detecting the nozzle-clogging are carried out in predetermined timing by the rotation of the cam shaft 135 as mentioned above. Upon rotation of the cam 124 caused by rotation of the cam shaft 135, the oscillating arm 126 is drawn by the spring 128 through the cam follower 125 and turned counterclockwise. The hollow pipe 126 is turned counterclockwise through the connecting rod 127 and the oscillating arm 123 to oscillate the contact opening 120 at the end toward the front side into contact with the recessed portion 121 provided in the communication pipe 116 with the end projected of the connector 137. The hollow pipe 126 causes the communication pipe 116 to force into the gap portion 15 against the resilient force of the spring 119 and then stops. At this time, the recessed portion 122 in the lower surface of the communication pipe 116 is positioned above the nipple 8 of the nozzle unit 7. When the nozzle unit 7 is moved upward, the nipple 8 comes into contact with the recessed portion 122 in the lower surface of the communication pipe 116. Thereby, a circuit is formed by the open portion 12 of the nozzle unit 7, the yarn hole 9, the pipe 123 of the communication pipe 116, the contact opening 120, the hollow pipe 126, the flexible tube 127 and the flow meter 128.

Accordingly, when the nozzle unit 7 is then actuated after the aforementioned operation to jet pressurized air from the first and second nozzles 10 and 11, an air flow in the direction of the nozzle unit 7 (arrow B) is generated within the hollow pipe 126 unless clogging around the nipple 8 is present, and the flow meter 128 detects a large amount of flow. If cleaning by the cleaning device is not sufficient and the fiber waste or the like is clogged near the nipple, the flow meter 128 detects an extremely small amount of flow or zero.

The thus measured flow rate is displayed on a display unit not shown. The operator knows an abnormal condition from the displayed value to effect sucking and cleaning of said portions of effect cleaning by hands.

It is to be noted that a flow comparison alarm device which, in case where said measured value is smaller than a preset value, goes to inform it to an operator may be connected to the flow meter 128.

Upon termination of detection of the aforesaid nozzle-clogging, the contact opening 120 is moved back by rotation of the cam 124. Therefore, the end of the communication pipe 116 of the connector 137 is projected frontwardly of the machine bed by the resilient force of the spring 128 and extended from the gap portion 15. An arrow A shows a direction of a suction air stream in the suction pipe 21.

According to the present invention, it is possible to clean an area which is very narrow between the front roller and the nozzle unit and in which dust containing short fibers or yarn waste tend to stay. If the device is actuated in association with the splicing when yarn is cut, said area can be cleaned every splicing, enabling contribution to enhancement of yarn quality and lowering of generation rate of yarn-cut.

What is claimed is:

1. In a spinning apparatus in which a nozzle unit for twisting a fiber bundle is provided adjacent a front roller of a draft part and has a suction opening for receiving the fiber bundle, a nozzle cleaning device comprising:

means for moving the suction opening of the nozzle unit toward and away from the draft part, wherein a gap is provided between the nozzle unit and the draft part upon the nozzle unit being moved away from the draft part;

a suction pipe, having a suction opening, for sucking yarn waste means for moving the suction opening of the suction pipe with respect to and toward the opening of the nozzle unit and to the gap formed between the draft part and the nozzle unit moved away from the draft part.

2. The nozzle cleaning device as claimed in claim 1, wherein the suction opening of the suction pipe has a diameter substantially the same as that of the suction opening of the nozzle unit.

3. The nozzle cleaning device as claimed in claim 2, wherein said suction opening of the suction pipe, upon being advanced into the gap, is directed toward the suction opening of the nozzle unit.

4. The nozzle cleaning device as claimed in claim 1, wherein a rotary cleaning body for fiber waste is further provided adjacent the suction opening of the suction pipe.

5. In a spinning apparatus in which a nozzle unit for twisting a fiber bundle is provided adjacent a front roller of a draft part and has a suction opening for receiving the fiber bundle, a nozzle cleaning device comprising:

means for moving the suction opening of the nozzle unit toward and away from the draft part, wherein a gap is provided between the nozzle unit and the draft part upon the nozzle unit being moved away from the draft part;

a suction pipe, having a suction opening, for sucking yarn waste;

means for moving the suction opening of the suction pipe toward the gap formed between the draft part and the nozzle unit moved away from the draft part; and a fiber waste gripping body provided adjacent the suction opening of the suction pipe, the fiber waste gripping body comprises a flat spring which is supported to be movable toward the suction opening of the suction pipe by means of an air cylinder so that fiber waste is gripped between the flat spring and the suction opening.

6. In a spinning apparatus in which a nozzle unit for twisting a fiber bundle is provided adjacent a front roller of a draft part and has a suction opening for receiving the fiber bundle, a nozzle cleaning device comprising:

means for moving the suction opening of the nozzle unit toward and away from the draft part, wherein a gap is provided between the nozzle unit and the draft part upon the nozzle unit being moved away from the draft part;

a suction pipe, having a suction opening, for sucking yarn waste;

means for moving the suction opening of the suction pipe toward the gap formed between the draft part and the nozzle unit moved away from the draft part; and a fiber waste gripping body provided adjacent the suction opening of the suction pipe, the fiber waste gripping body comprises a plurality of gripping plates which are turnably pivoted at the side of the suction opening of the suction pipe, so that the gripping plates can hold fiber waste therebetween.

7. In a spinning apparatus in which a nozzle unit for twisting a fiber bundle is provided adjacent a front roller of a draft part and has a suction opening for receiving the fiber bundle, a nozzle cleaning device comprising:

means for moving the suction opening of the nozzle unit toward and away from the draft part, wherein a gap is provided between the nozzle unit and the draft part upon the nozzle unit being moved away from the draft part;

a suction pipe, having a suction opening, for sucking yarn waste;

means for moving the suction opening of the suction pipe toward the gap formed between the draft part and the nozzle unit moved away from the draft part; and a rotary cleaning body for fiber waste provided adjacent the suction opening of the suction pipe, the rotary cleaning body comprises a shaft which is supported within the suction pipe being freely rotatable, blades secured adjacent one end of the shaft, and a brush member secured adjacent another end of the shaft to be protruding from the suction opening.

8. In a spinning apparatus in which a nozzle unit for twisting a fiber bundle is provided adjacent a front roller of a draft part and has a suction opening for receiving the fiber bundle, a nozzle cleaning device comprising:

means for moving the suction opening of the nozzle unit toward and away from the draft part, wherein a gap is provided between the nozzle unit and the draft part upon the nozzle unit being moved away from the draft part;

a suction pipe, having a suction opening, for sucking yarn waste;

means for moving the suction opening of the suction pipe toward the gap formed between the draft part and the nozzle unit moved away from the draft part; and a hollow pipe connected to a flow meter at a base end thereof provided in communication with the suction opening of the nozzle unit and is supported such that the hollow pipe can be advanced to the gap after the suction pipe has advanced to the gap and has been retracted therefrom.

9. The nozzle cleaning device as claimed in claim 8, wherein a connector is disposed at a side of the front roller and the nozzle unit, said connector turnably supporting a communication pipe including a first recessed portion which comes into contact with the suction opening of the nozzle unit, and a second recessed portion which comes into contact with an opening of the hollow pipe.

10. In a spinning apparatus in which a nozzle unit for transporting and twisting a fiber bundle is provided on the side of a front roller of a draft part, the nozzle unit having a suction opening, a nozzle cleaning device comprising:

a first support member movably supporting the suction opening of the nozzle unit;

means for moving the suction opening of the nozzle unit between a first position close to a nipped point of the front roller and a second position away therefrom, wherein a gap is provided between the nozzle unit and the front roller upon the nozzle unit being in the second position;

a suction pipe having a suction opening;

a second support member movably supporting the suction opening of the suction pipe; and means for moving the suction opening of the suction pipe with respect to and toward the suction opening of the nozzle unit and into the gap.

11. The nozzle cleaning device as claimed in claim 10, further comprising a dust collecting box connected to the suction pipe, wherein said suction pipe and said dust collecting box are mounted on a truck which runs along a front of a machine frame on which a plurality of nozzle units are provided.

* * * * *